US009890638B2

(12) United States Patent
Baker, Jr. et al.

(10) Patent No.: US 9,890,638 B2
(45) Date of Patent: Feb. 13, 2018

(54) VARIABLE DISPLACEMENT SYSTEM

(71) Applicants: George Paul Baker, Jr., Denham Springs, LA (US); Anders Stephen Gerhart, Baton Rouge, LA (US)

(72) Inventors: George Paul Baker, Jr., Denham Springs, LA (US); Anders Stephen Gerhart, Baton Rouge, LA (US)

(73) Assignee: Angular Motion Technologies, LLC, Denham Springs, LA (US)

( * ) Notice: Subject to any disclaimer, the term of this patent is extended or adjusted under 35 U.S.C. 154(b) by 391 days.

(21) Appl. No.: 14/436,618

(22) PCT Filed: Sep. 30, 2013

(86) PCT No.: PCT/US2013/062741

§ 371 (c)(1),
(2) Date: Apr. 17, 2015

(87) PCT Pub. No.: WO2015/047420

PCT Pub. Date: Apr. 2, 2015

(65) Prior Publication Data

US 2016/0168995 A1 Jun. 16, 2016

(51) Int. Cl.

| | |
|---|---|
| ***F01B 3/00*** | (2006.01) |
| ***F16H 1/00*** | (2006.01) |
| ***F01B 21/02*** | (2006.01) |
| ***F04B 1/12*** | (2006.01) |
| ***F04B 9/02*** | (2006.01) |
| ***F04B 9/04*** | (2006.01) |
| ***F02D 15/00*** | (2006.01) |

(52) U.S. Cl.
CPC ..... *F01B 21/02* (2013.01); *F02D 15/00* (2013.01); *F04B 1/124* (2013.01); *F04B 9/02* (2013.01); *F04B 9/045* (2013.01)

(58) Field of Classification Search
CPC ..... F04B 3/00; F01B 7/00; F01B 7/02; F01B 7/14; F01B 21/02; F02B 75/26; F02B 75/28; F02B 75/282; F02B 3/045
USPC ..... 92/69 R, 75; 91/501
See application file for complete search history.

(56) References Cited

U.S. PATENT DOCUMENTS

| | | | | | |
|---|---|---|---|---|---|
| 1,689,419 | A * | 10/1928 | Bronander | F04B 3/00 | 123/51 AA |
| 3,485,221 | A * | 12/1969 | Feeback | F01B 7/14 | 123/51 AA |
| 5,031,581 | A * | 7/1991 | Powell | F01B 3/0005 | 123/51 B |
| 5,507,253 | A * | 4/1996 | Lowi, Jr. | F01B 3/045 | 123/56.9 |
| 6,122,984 | A * | 9/2000 | Willmot | B23B 31/28 | 475/332 |
| 6,547,689 | B2 * | 4/2003 | Baker, Jr. | F16H 35/008 | 172/13 |
| 2001/0036880 | A1 | 11/2001 | Baker, Jr. | | |

(Continued)

*Primary Examiner* — Thomas E Lazo
*Assistant Examiner* — Dustin T Nguyen
(74) *Attorney, Agent, or Firm* — Chen-Chi Lin

(57) ABSTRACT

Variable displacement systems, utilizing a phase relationship controller to determine and control the volumetric displacement of liquid and gas compression systems, including applications of said systems to continuously variable, constant speed power transmissions and to variable compression-ratio internal combustion engines.

19 Claims, 11 Drawing Sheets

(56) References Cited

U.S. PATENT DOCUMENTS

2012/0024147 A1* 2/2012 Powell ..... F01B 3/045
92/32

* cited by examiner

Counter-Clock Wise Rotation a -> d

VARIABLE DISPLACEMENT SYSTEM

DISCLOSURE

Embodiments contained within this disclosure incorporate the functionality of the Angular Motion Transmitter, subject of U.S. Pat. No. 6,547,689. Said patent is incorporated by reference as though fully set forth herein.

As that term is used herein, 'phase relationship controller' describes a functionality of the Angular Motion Translator wherein certain features and elements of said Angular Motion Translator allow for the phase relationship of two rotating elements to be directly and mechanically controlled by adjusting the phase relationship of two non-rotating elements. The term 'phase relationship controller' also includes all other means of controlling the phase relationship of two rotating elements.

As that phrase is used herein, 'positive displacement device' is a device or component arranged and configured to displace a substantially consistent volume of fluid during a cycle, For example, a piston in a positive displacement piston pump would be considered a positive displacement device. Such positive displacement devices can be applied to both liquid and gaseous fluids.

As that term is used herein, 'plesiochronous' describes elements that operate in approximate synchronization and includes for example the relationship between a solid output shaft and a concentric, cylindrical tube. An element that is plesiochronous with respect to a second element may have a phase difference that is positive, negative, or zero with respect to the second element. However, an element that is plesiochronous with respect to a second element would not have a fixed phase difference with respect to the second element.

Some embodiments of this disclosure provide a variable displacement compression system and a method of using it in a continuously adjustable manner over a wide operating range of adjustment in a highly precise and durable manner.

Other embodiments provide said variable displacement apparatus and method, wherein said apparatus serves as a mechanical fluid transmission which is continuously variable over a wide range including zero.

In embodiments described within this disclosure, the primary output of the Phase relationship controller is one and the same with the input and as such will always directly replicate the angular velocity, phase and power of the input. The secondary output of the Phase relationship controller is driven through a planetary gearbox, which, by nature of its construction, can accept two additional inputs. The angular velocity and phase of the two additional inputs relative to each other are replicated as a corresponding angular velocity and phase relationship in the secondary output relative to the primary output, [added to or subtracted from] the angular velocity and phase of the primary output. When one of the additional inputs is held stationary, a simple mechanism, such as a worm gear, can be used to precisely and reliably control the relative phase of the two output shafts.

In one embodiment; the primary phase relationship controller output drives an eccentric cylindrical shaft. Said shaft passes through an outer cylindrical shaft with an eccentric, oval opening in the middle. Said outer shaft is driven by the secondary phase relationship controller output through a keyed and slotted coupling that allows the outer shaft to freely move radially. An adjustment to the relative phase of the two shafts therefore effects the amount of eccentricity of the outer shaft. Said outer shaft drives one or more pairs of pistons via a sliding spacer such that the pistons reciprocate in radially oriented cylinders. The fluid output from each cylinder would typically be manifolded together, although this is not essential as each piston has a variable stroke length within its corresponding cylinder In another embodiment; two matching swash plates are formed such that the outer circular edge of each swash plate forms a track inscribing a sinusoidal pattern along a line parallel to the axis of the swash plate. Said swash plates are each driven by an output shaft of a phase relationship controller and are arranged at either end of a cylinder block containing one or more axial cylinders. Opposed pistons in each cylinder are driven by the swash plates such that an adjustment to the relative phase of the two rotating swash plates will effect a variation of the volume displaced in each cylinder by the opposed pistons. The fluid output from each cylinder would typically be manifolded together, although this is not essential as each set of opposed pistons will have a variable volume displacement within their common cylinder.

BEST MODES FOR CARRYING OUT THE INVENTION

Some embodiments of the invention will now be described with reference to the accompanying drawings, wherein like numerals refer to like elements throughout. The terminology used in the description presented herein is not intended to be interpreted in any limited or restrictive manner simply because it is used in conjunction with a detailed description of certain specific embodiments of the invention. Furthermore, embodiments of the invention may include several novel features, no single one of which is solely responsible for its desirable attributes, or which is essential for practicing the inventions described herein.

Figure 1:
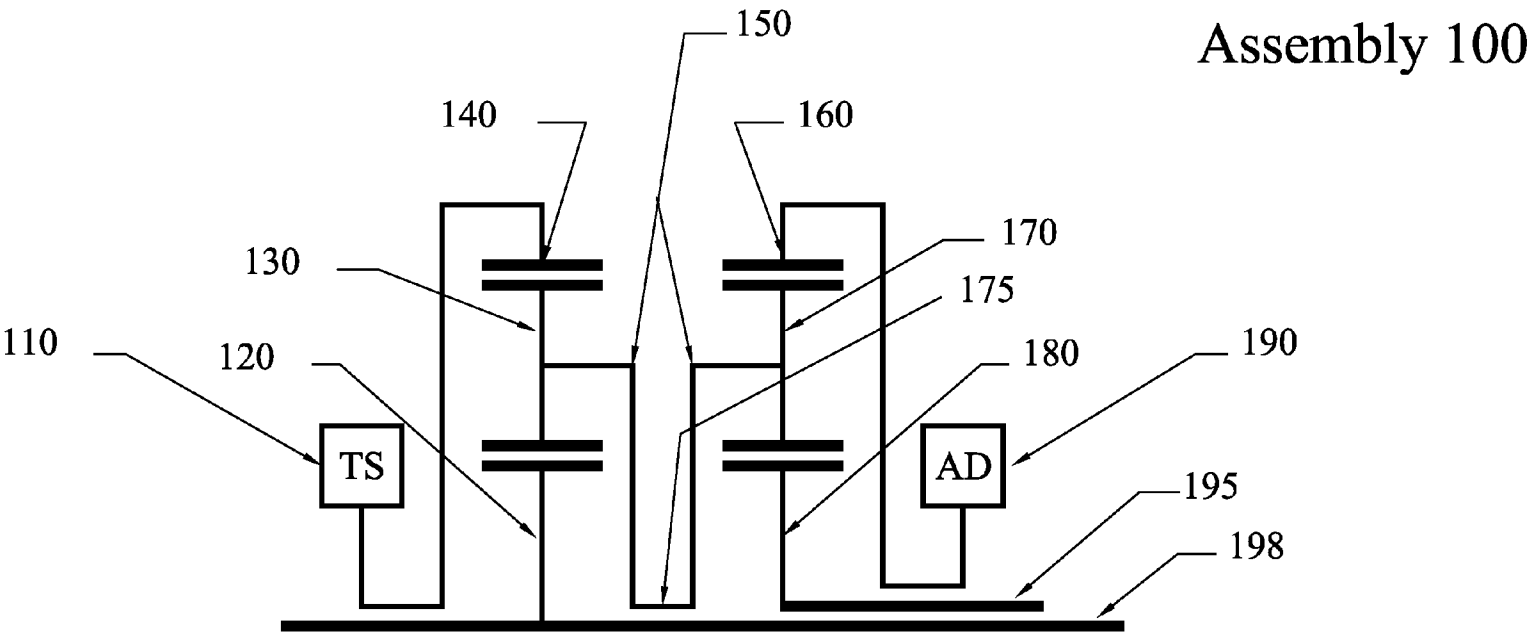
FIG. 1 is a schematic view of a mirrored planetary gearbox used as a phase relationship controller.
Figure 2:
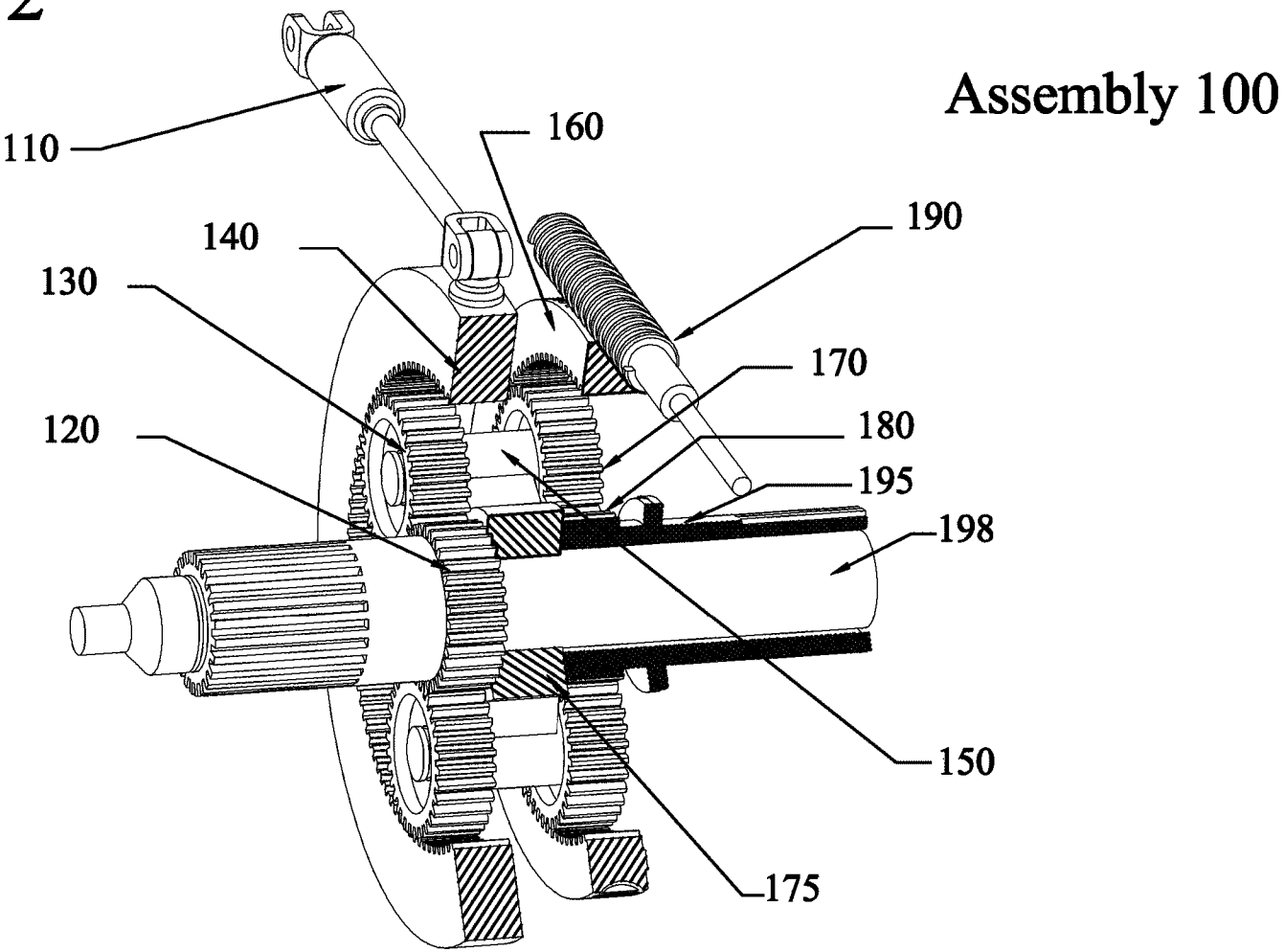
FIG. 2 is a cut-a-way view of a phase relationship controller with a torque sensor and worm gear adjustment device.

Embodiments described herein utilize a phase relationship controller, illustrated in FIG. 1 & FIG. 2, said phase relationship controller (Assembly 100) consisting of two mirrored planetary gear systems, where the significant feature allows for the setting and controlling of the relative phase of two shafts rotating under power. (FIG. 1 is schematic diagram of the phase relationship controller; FIG. 2 is the mechanical embodiment used in this description). In most applications of the phase relationship controller (Assembly 100), one output shaft consists of a cylindrical tube (195) mounted concentrically around a solid output shaft (198), said solid output shaft (198) being integrally the same as the power input shaft. Mirrored planet gear systems with corresponding planet gears (130, 170), with each pair mounted on a common axis shaft (150), said axis shafts (150) all mounted on a common axis intercarrier (175) free to rotate concentrically about the solid input/output shaft (198). These planet gears (130, 170) are each intermeshed with two sun gears (120, 180), one of said sun gears (120) is fixed to the solid input/output shaft (198), and the other of said sun gears (180) is fixed to the cylindrical output shaft (195). Each planet system is meshed within an internal gear/annulus ring (140, 160). Said annulus ring gears (140, 160) are held fixed except when a phase differential is introduced between the two ring gears.

Power applied to the input shaft (198) will rotate the input sun gear (120) which will rotate the input planet gears (130). While the input annulus ring (140) is held static, the rotation of the input planet gears (130) will induce a rotation of the axis intercarrier assembly (175). The rotation of the axis intercarrier assembly (175) will cause the output planet gears (170) to rotate about the input shaft (198), which, while the output annulus ring (160) is held static, will cause the output sun gear (180) to rotate about the input/output shaft (198). Said output sun gear (180), being mechanically attached to the cylindrical output tube (195), will in turn cause said output tube (195) to rotate.

The mirrored planetary gear systems have identical tooth ratios, sun gears (120, 180) to planet gears (130, 170), planet gears (130, 170) to annulus ring (140, 160). Because of this, the gear ratio that induces the rotation of the axis intercarrier (175) relative to the input sun gear (120) is inverted by the output planetary gear system, with the effect that, while the two annulus rings (140, 160) are held static, the output sun gear (180) will rotate at the same angular velocity as the input sun gear. (120) That is, while said input and output annulus rings (140, 160) are held static, the cylindrical output tube (195) and the solid output shaft (198) will both rotate at the same speed.

If, while the input annulus ring (140) is held static, the output annulus ring (160) is rotated by some Actuation Device (190), the rotation of the output annulus ring (160) will be added to, or subtracted from, the rotation induced in the output planet gears (170) by the axis intercarrier (175), said additional rotation will thereby be added to, or subtracted from, the rotation of the output sun gear (180), in turn forcing the cylindrical output tube (195) to assume a new, differential phase relationship with the solid output shaft (198). Thus, the Actuation Device (190) is able to fix and control the relative phase relationship of the cylindrical output tube (195) to the solid output shaft (198).

All power delivered to the input shaft (198) will be transmitted through the combined output tube (195) and output shaft (198), but only while the two annulus rings (140, 160) are held static. The magnitude of the force required to hold the two annulus rings (140, 160) static relative to each other, is equal to the torque being delivered to the input shaft (198) divided by the normal distance from the rotational centerline of the input/output shaft (198) to the point at which the force is applied. If, in these embodiments, the output annulus ring (160) is rigidly fixed to an Actuation Device (190), then the input annulus ring (140) can be attached to a force sensor (110). The electronic output from the force sensor (110) can then be mathematically manipulated to represent the instantaneous torque being transmitted through the phase relationship controller (Assembly 100).

As is shown in FIGS. 1 and 2, the input/output shaft (198) is formed into one piece. Because of this, the significant, phase adjusting feature of the phase relationship controller (100) can be utilized either through the use of two output assemblies as illustrated above [i.e. output shaft (198) and output tube (195)], or by using one output shaft rigidly connected to the output tube (198) while referencing the phase of the input splined shaft. When used as such in an application, the output tube (195) can be formed as a solid shaft, thereby providing greater power transmission capacity.

Figure 3:
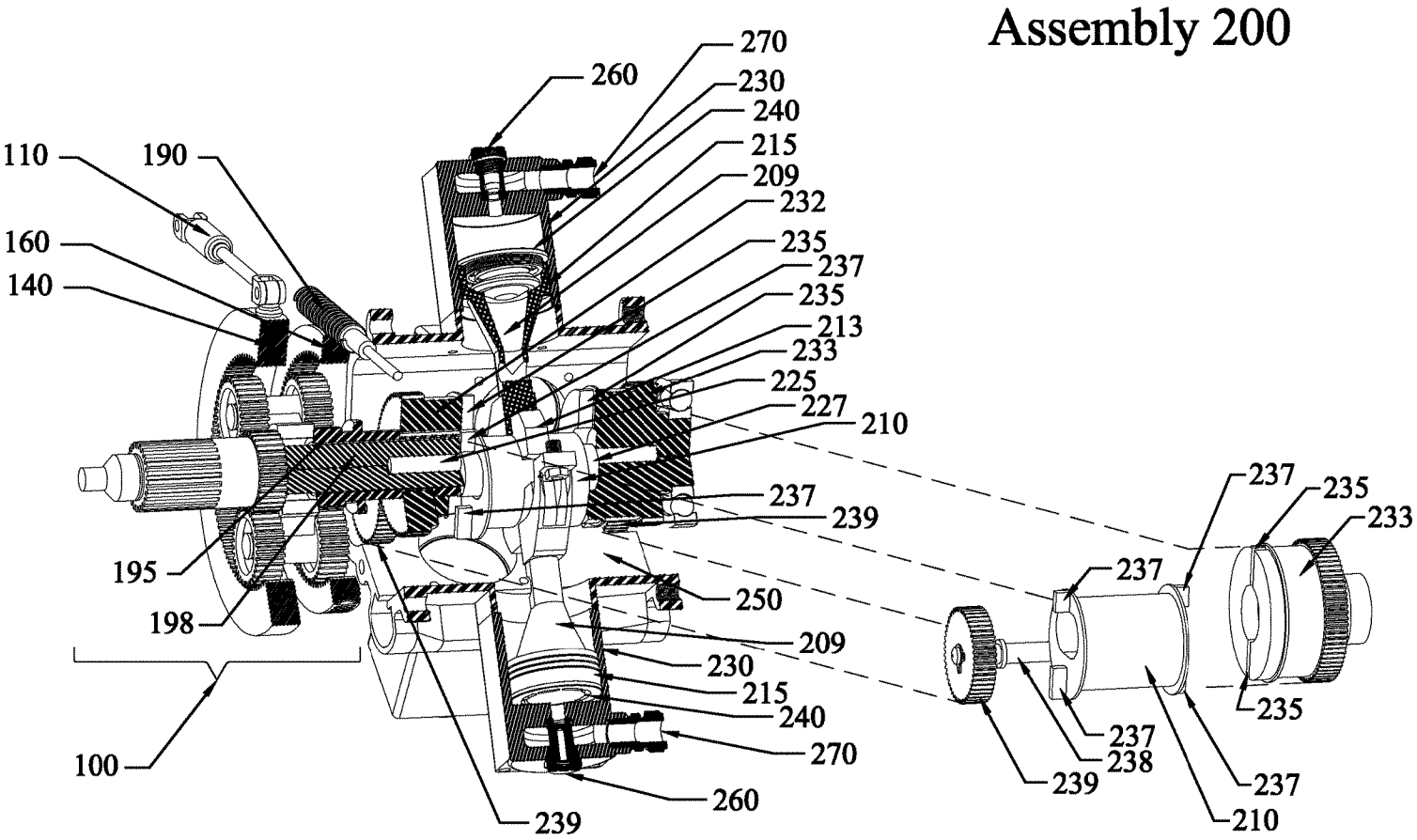
FIG. 3 is a cut-a-way view of a variable displacement radial piston pump with variable stroke length.
Figure 4:
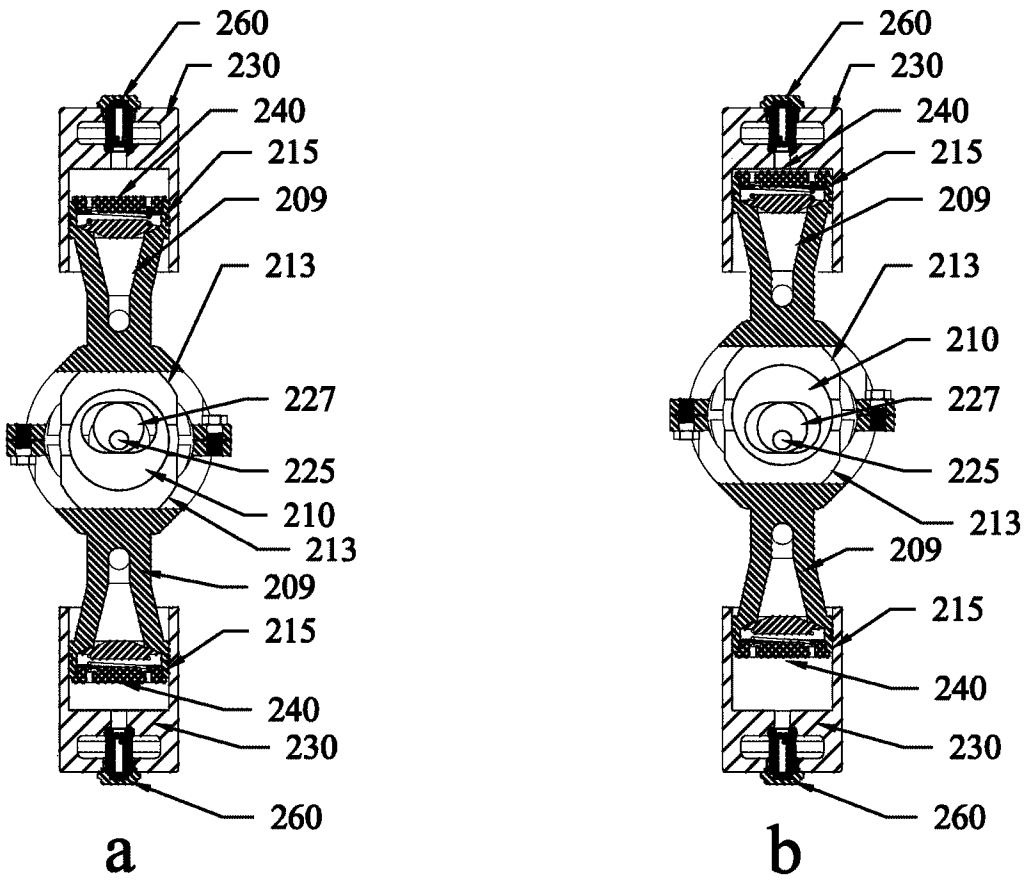
FIG. 4 is a cross-sectional view of a radial piston set and drive shafts, shown adjusted for minimum and maximum stroke length.
Figure 5:
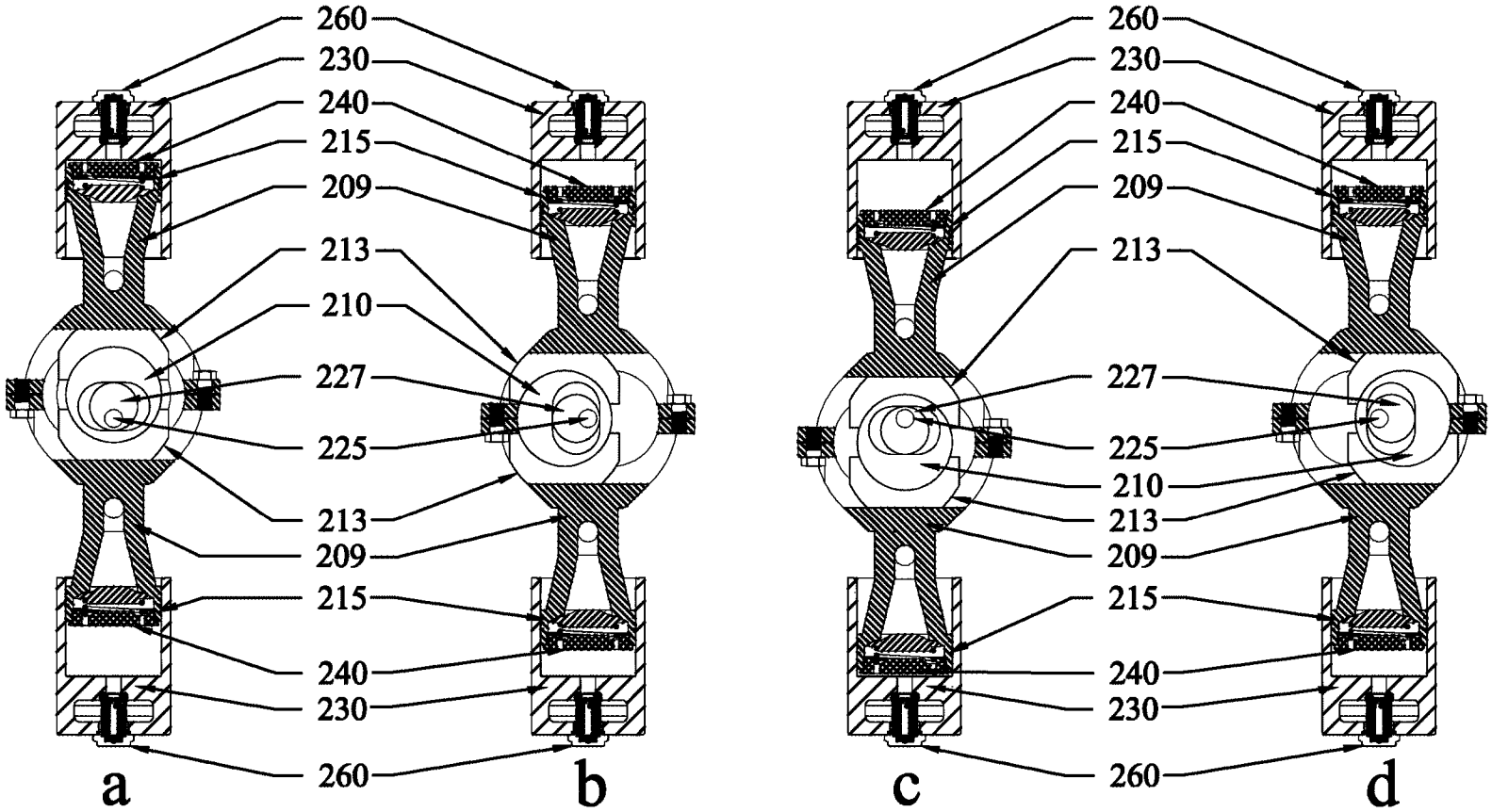
FIG. 5 is a series of radial piston cross-sections, shown in sequence as the drive shafts rotate counterclockwise through one revolution.

FIGS. 3, 4 & 5 illustrate a phase relationship controller (100) applied to a radial piston, variable stroke, variable displacement hydraulic pump (200), said pump consisting of linearly reciprocating pistons (215), each held within an in-line cylinder (230) and arranged on either side of an eccentric cam (210) by means of hollow, rigid connecting rods (209) and sliding spacers (213). Said hollow, rigid connecting rods (209) function to hold the opposite pistons (215) in-line, provide a surface through which the sliding spacers (213) can deliver force into the piston, and provide an intake path through which hydraulic fluid can be drawn into each cylinder (230) for compression.

Said pistons (215) have a check valve (240) secured into its cylinder end. Said hollow, rigid connecting rods (209) have central ports and interior passages allowing the movement of fluid from the pump casing (250) through the hollow, rigid connecting rods (209), in one direction through the check valve (240) and into the cylinder (230). Said check valve (240) mounted in the cylinder end of each piston (215) functions as the intake for the pump, allowing the fluid to be suctioned into the cylinder space as the piston (215) retracts, but blocking the backflow of fluid as the piston (215) moves into the cylinder (230) decreasing the effective volume of the space within the cylinder (230), and pressurizing the fluid. Another check valve (260) is mounted into the head of each cylinder assembly (230) in such a way as to allow the flow of pressurized hydraulic fluid out through the cylinder outlet port (270), but to block the backflow of fluid into the cylinder (230) space.

There is an elongated oval opening through the driver cam (210) through which is inserted an inner, circular, cylindrical, eccentric cam (227) mounted on a shaft (225) keyed in to a drive spline, cut into the solid output shaft (198) of the phase relationship controller. Additionally, there are rigidly mounted to the drive cam (210) two slot keys (237) on each side that are captive within drive slots (235) cut into the input side drive spindle (232) and the output drive spindle (233). The input side drive spindle is driven by the cylindrical output tube (195). Adjacent to and parallel with the drive cam (210) is an idler shaft (238) with two drive gears (239) which mechanically connects the input side and output side drive spindles (232, 233), so said spindles will rotate together under power at the same speed. The input side and output side drive spindles (232, 233) thereby drive, through the slots (235) and keys (237), both sides of the eccentric drive cam (210). While held captive by means of its slot keys (237) within the drive slots (235), the drive cam (210) can translate radially while rotating, and be adjusted continuously and in a non-stepwise manner from 0% eccentricity through 100% eccentricity.

While the input & output annulus rings (140, 160) are held static, the output shaft (198) drives the eccentric inner cam (227), and the cylindrical output tube (195) drives the eccentric drive cam (210) through the drive slots (235) and the slot keys (237), rotating at the same speed with a fixed phase relationship.

When the output annulus ring (160) is rotated by means of the Actuation Device (190), the cylindrical output tube (195) will advance or retard relative to the output shaft (198) in proportion to the rotation of the output annulus ring (160).

When the phase relationship between the output shaft (198) and the output tube (195) changes, a corresponding phase relationship is produced between the inner eccentric cam (227) and the drive cam (210). As the inner cam (227) rotates within and relative to the oval opening of the drive cam (210), the amount of eccentricity of the drive cam (210) is altered.

As the entire assembly (200) rotates under power, an equal and opposite torque is produced in the input annulus ring (140), relative to the output annulus ring (160). This torque is resisted by the force element of the Torque Sensor (110), whose electronic output will be directly proportional to the amount of torque being transmitted through the assembly.

The rotation of drive cam (210) will cause the pistons (215) to reciprocate with a stroke relative to the amount of eccentricity of the drive cam (210). As the amount of eccentricity of the drive cam (210) varies between 0% and 100%, the stroke of the pistons (215) will correspondingly vary between 0% and 100%. The force transmitted into the pistons (215) by the drive cam (210), passes through the sliding spacers (213) which move side-to-side perpendicularly to the line of movement of the pistons (215) while maintaining continuous contact with both the surface of the drive cam (210) and the inside surface of the hollow, rigid connecting rods (209). The sliding spacers (213) thereby allow the reciprocating motion of the drive cam (210) to be translated into the linear motion of the hollow, rigid connecting rods (209) and pistons (215) while maintaining substantial area contact between the surfaces.

FIG. 4*a* illustrates a single, two-piston mechanism at 0% eccentricity. Under these conditions, both pistons (215) will remain motionless while the drive cam (210) rotates within the sliding spacers (213), and no pumping will take place. FIG. 4*b* illustrates a single, two-piston mechanism at 100% eccentricity. In this case, the pistons will execute the maximum stroke, and the pump will produce pressurized fluid at its maximum capacity.

FIG. 5 illustrates four 90 degree quadrants of piston action at maximum, 100% eccentricity of the drive cam (210). FIG. 5*a* shows the upper piston (215) at Topdead-center relative to its corresponding cylinder (230), and the lower piston (215) at Bottom-dead-center relative to its corresponding cylinder (230). At this position, the sliding spacers (213) will both be centered on the hollow, rigid connecting rods (209). FIG. 5*b* illustrates the positions of the parts after the drive cam (210) has rotated 90 degrees counter-clockwise from the upper piston (215) Top-dead-center position of FIG. 5*a*. At this position, both pistons (215), and both hollow, rigid connecting rods (209) will be at the middle of their respective strokes, and the sliding spacers (213) will both have translated to one side of the hollow, rigid connecting rods (209). FIG. 5*c* shows the positions of the various parts after an additional 90 degrees of rotation of the drive cam (210). In this position, the sliding spacers (213) will have translated back to the center of the hollow, rigid connecting rods (209). The lower piston (215) will be at its Top-dead-center relative to its corresponding cylinder (230), and the upper piston (215) will be at its Bottom-dead-center position relative to its corresponding cylinder (230). Another 90 degrees of rotation of the drive cam (210) will bring the various parts into the positions shown in FIG. 5*d*. In this position, the pistons (215) and the hollow, rigid connecting rods (209) will again be midway in their respective strokes, and the sliding spacers (213) will have translated to the opposite side of the hollow, rigid connecting rods (209) as in FIG. 5*b*. A further 90 degree rotation of the drive cam (210) will return the related parts to the positions shown in FIG. 5*a*.

Figure 6:
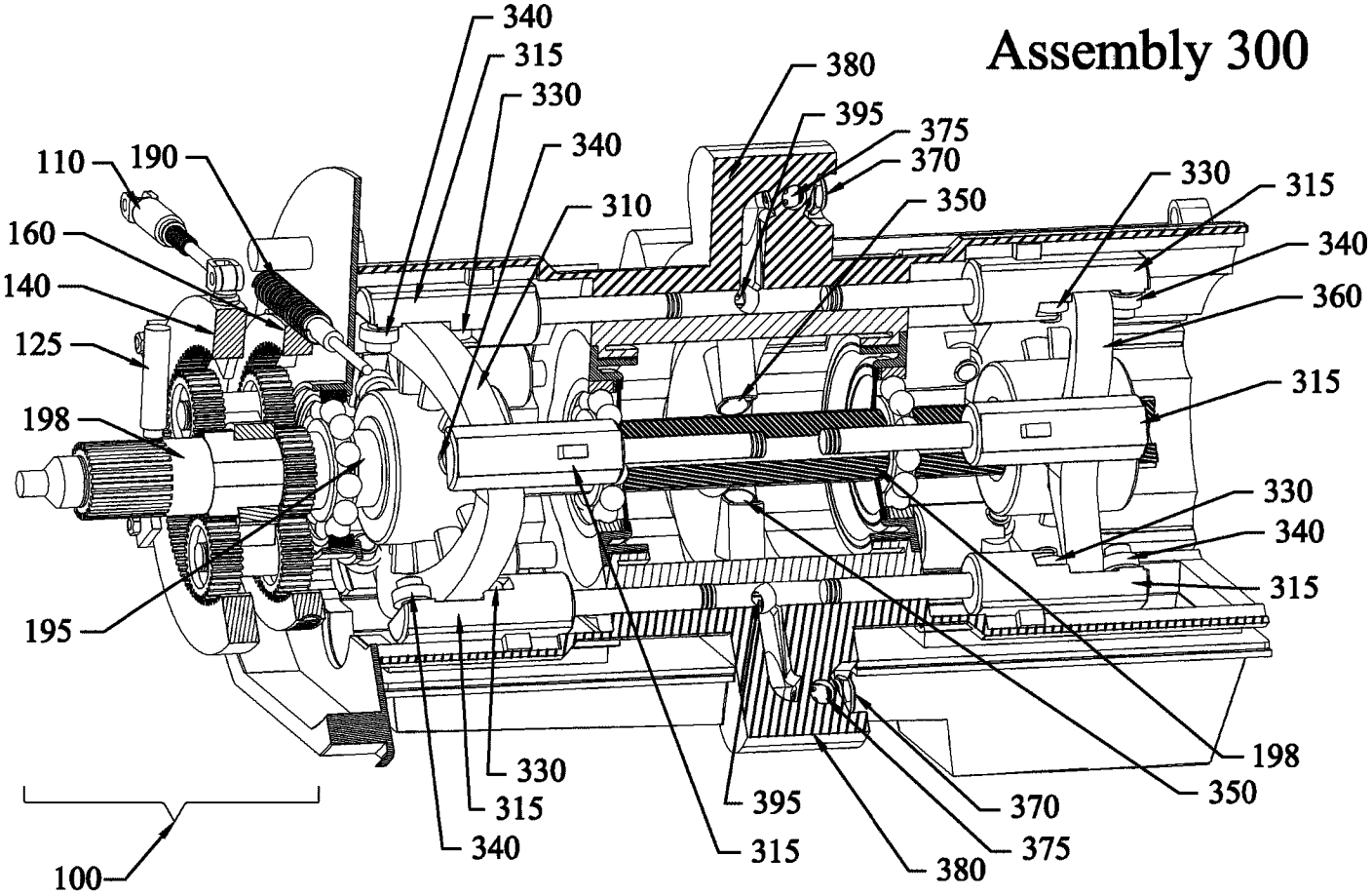
FIG. 6 is a cut-a-way view of a variable displacement axial piston pump with a fixed stroke length.

Another embodiment of this invention is illustrated in FIG. 6 a phase relationship controller (100) applied to an axial, opposed-piston, variable displacement hydraulic pump (300). Said pump consisting of opposed pistons (315) organized around and parallel to a central composite axis. An enclosing structure (380) around the entire assembly has a number of void spaces providing the following functions:

1. A structural casing to hold all moving parts together in proper alignment,
2. A central cavity acting as a reservoir for hydraulic fluid,
3. Intake ports (350) for drawing in (suctioning) hydraulic fluid from the central reservoir into the cylinder,
4. Mounting ports for intake check valves (395),
5. Cylinder cavities, within which the opposed pistons (315) can operate.
6. Mounting ports for the exhaust check valves (370), and
7. Exhaust ports (375) for routing of pressurized fluid to an accumulation point.

The pistons (315) at one side of the cylinder spaces are held captive to a tracked swash plate (310 or 360) by means of suction rolling bearings (340) and compression rolling bearings (330). The primary swash plate (310) is rigidly fixed through a splined coupling to the cylindrical output tube (195) of the phase relationship controller (100). The secondary swash plate (360) is rigidly fixed through a splined coupling to the input shaft (198) of the phase relationship controller (100), said input shaft (198) is shown in FIG. 6 in a cutaway view as it moves through the centerline of the swash plates (310, 360). The swash plates (310, 360) each have a sinusoidally inscribed track whose thickness varies to accommodate the varying angle of incidence between the suction rolling bearings (340) and the compression rolling bearings (330) as the track traces its sinusoidal motion. In this illustration, each swash plate (310, 360) track inscribes two full cycles for each full rotation of the central drive (195, 198). The sinusoidal track is fixed, and thereby the stroke of the captive pistons (315) also has a fixed dimension.

When the swash plates (310, 360) are precisely in phase, the peaks and valleys of their sinusoidal tracks will precisely align, as will the captive pistons. Under these conditions, the pistons (315) will move in and out in concert and will develop their maximum displacement with each stroke. When the phase relationship of the swash plates (310, 360) is altered by 90 degrees, the peaks of the primary swash plate (310) will align with the valleys of the secondary swash plate (360). In this state, as the swash plates (310, 360) are rotated, the pistons (315) will still translate through their entire stroke, but no pumping action will occur because one piston will be retracting in precise concert with the opposing pistons extension the volumetric displacement will be zero.

While the input & output annulus rings (140, 160) are held static, the output shaft (198) drives the secondary swash plate (360), and the cylindrical output tube (195) drives the primary swash plate (310) both of said swash plates will rotate at the same speed with a fixed phase relationship.

When the output annulus ring (160) is rotated by means of the Actuation Device (190), the cylindrical output tube (195) will advance or retard relative to the output shaft (198) in proportion to the rotation of the output annulus ring (160).

When the phase relationship between the output shaft (198) and the output tube (195) changes, a corresponding phase relationship is produced between the swash plates (310, 360). As noted above, the change in the phase relationship between the swash plates (310, 360) is reproduced in the opposed pistons (315). Thereby, the Actuation Device (190) can set and control the effective displacement of the opposed piston (315) cylinder (380) system from 0% through 100% in a continuous, nonstepwise manner.

As the entire assembly (300) rotates under power, an equal and opposite torque is produced in the input annulus ring (140), relative to the output annulus ring (160). This torque is resisted by the force element of the Torque Sensor (110), whose electronic output will be directly proportional to the amount of torque being transmitted through the assembly. Furthermore, the addition of rotational speed sensor (125) to the phase relationship controller (100) will provide for the electronic calculation of the instantaneous power being transmitted through the assembly.

Figure 7:
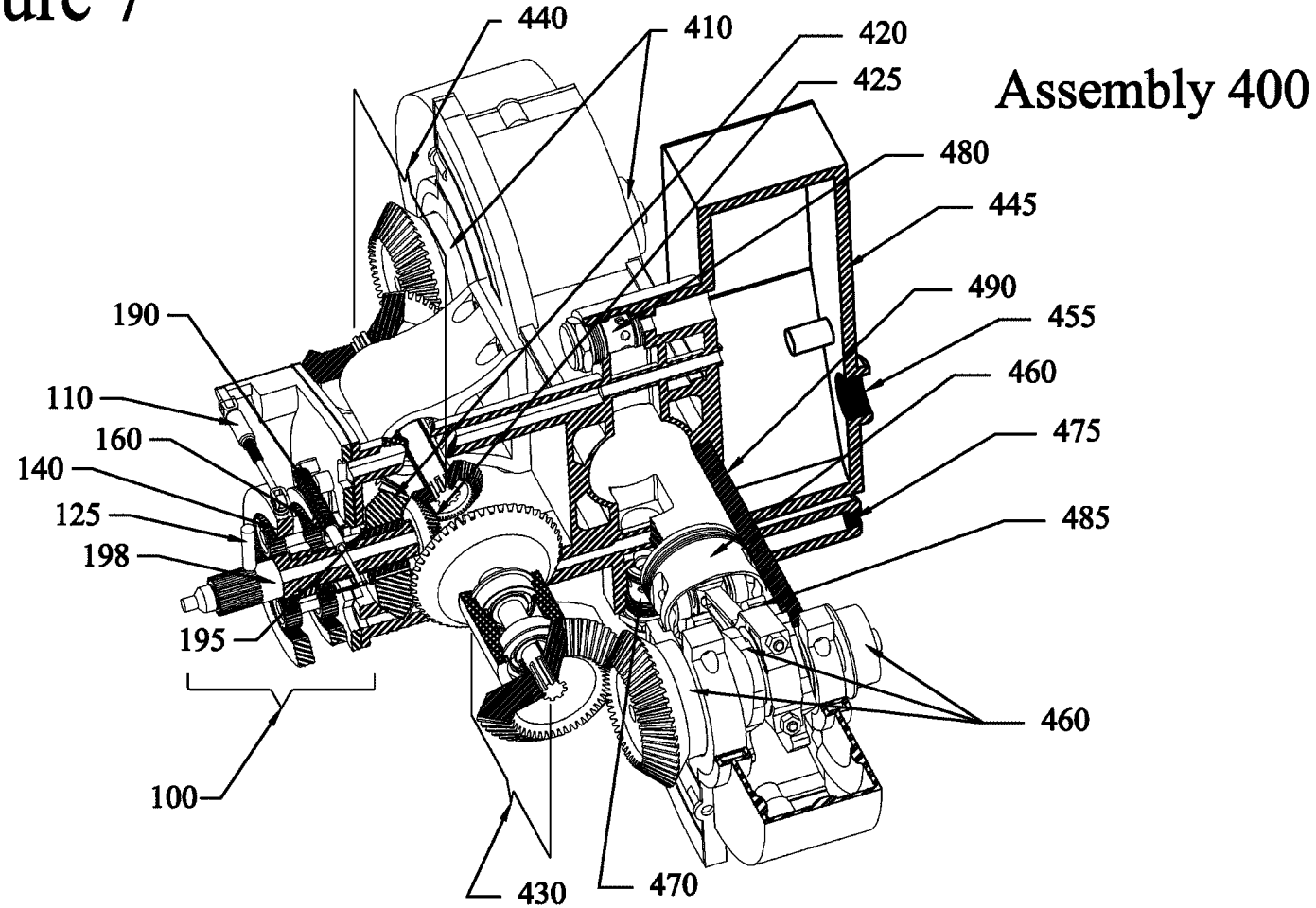
FIG. 7 is a cut-a-way view of a variable displacement dual crankshaft piston pump wherein the crankshafts are each driven by the separate outputs of a phase relationship controller.

Another embodiment of this invention is illustrated in FIG. 7; a variable displacement dual crankshaft opposed piston pump (400) wherein the crankshafts are each driven by separate outputs of the phase relationship controller (100). As shown in FIG. 7, the left side crankshaft (410) is driven by a drive shaft assembly (440) driven by a bevel gear (425) fixed to the output shaft (198) of the phase relationship controller (100). The alternate crankshaft (460) is driven by another drive shaft assembly (430) which is driven by a bevel gear (420) fixed to the output tube (195) of the phase relationship controller (100).

The casing (490) of said opposed-piston pump (400) provides the structure for the assembly, and also includes a cylindrical void space within which the stroking action of the opposed-pistons (460) is enclosed, and the inlet and outlet passages for hydraulic fluid. The inlet manifold of the casing (490) contains a mounting port for the inlet check valve (480). The inlet manifold is physically joined to a fluid reservoir (445). In a similar manner, the discharge manifold contains a mounting port for the outlet check valve (470), and is physically integral with the discharge port (475). The pistons (460) are each connected to their respective crankshafts (410, 460) by means of a throw-rod (485).

As the pistons (460) move further apart from each other, fluid is suctioned from the reservoir (445) through the inlet check valve (480) and into the cylindrical void.

During a suction stroke, fluid is prevented from back flowing from the outlet port (475) by the one-way action of the outlet check valve (470).

As the pistons (460) are driven closer together by the action of the crankshafts (410, 460) and throw-rods (485), the pressurized fluid is forced out of the outlet port (475) through the outlet check valve (470). At the same time, fluid is prevented from back flowing into the reservoir (445) by the one-way action of the inlet check valve (480).

In a manner similar to that of FIG. 6, the stroke length of the pistons (460) remains constant, but the effective volumetric displacement of the pump is dependent upon the phase relationship between the two pistons (460) as they cycle through their stroke.

When the piston (460), throw-rod (485) and crankshaft (410, 460) assemblies are precisely 180 degrees out of phase, the pistons (315) will move in and out in concert and will develop their maximum displacement with each stroke. When the phase relationship of the crankshafts (410, 460) is altered by 180 degrees, Top-dead-center of one piston (460) will coincide with Bottom-dead-center of the other piston (460). In this state, the pistons (460) will still translate through their entire stroke, but no pumping action will occur because one piston will be retracting in precise concert with the opposing piston's extension the volumetric displacement will be minimum.

While the input & output annulus rings (140, 160) are held static, the output shaft (198) drives the left-hand drive shaft assembly (440) by means of one bevel gear (425), said drive shaft assembly (440) drives the left-hand crankshaft (410) and the cylindrical output tube (195) drives the opposite drive shaft assembly (430) through a bevel gear (420), said drive shaft assembly (430) drives, in turn, the opposite crankshaft (460), and both of said crankshafts (410, 460) will rotate at the same speed with a fixed phase relationship.

When the output annulus ring (160) is rotated by means of the Actuation Device (190), the cylindrical output tube (195) will advance or retard relative to the output shaft (198) in proportion to the rotation of the output annulus ring (160).

When the phase relationship between the output shaft (198) and the output tube (195) changes, a corresponding phase relationship between the crankshafts (410, 460) is altered. As noted above, the change in the phase relationship between the crankshafts (410, 460) is reproduced in the opposed pistons (460). Thereby, the Actuation Device (190) can set and control the effective displacement of the opposed piston (460) cylinder (490) system from minimum through maximum in a continuous, non-stepwise manner.

As the entire assembly (400) rotates under power, an equal and opposite torque is produced in the input annulus ring (140), relative to the output annulus ring (160). This torque is resisted by the force element of the Torque Sensor (110), whose electronic output will be directly proportional to the amount of torque being transmitted through the assembly. Furthermore, the addition of a rotational speed sensor (125) to the phase relationship controller (100) will provide for the electronic calculation of the instantaneous power being transmitted through the assembly.

Figure 8:
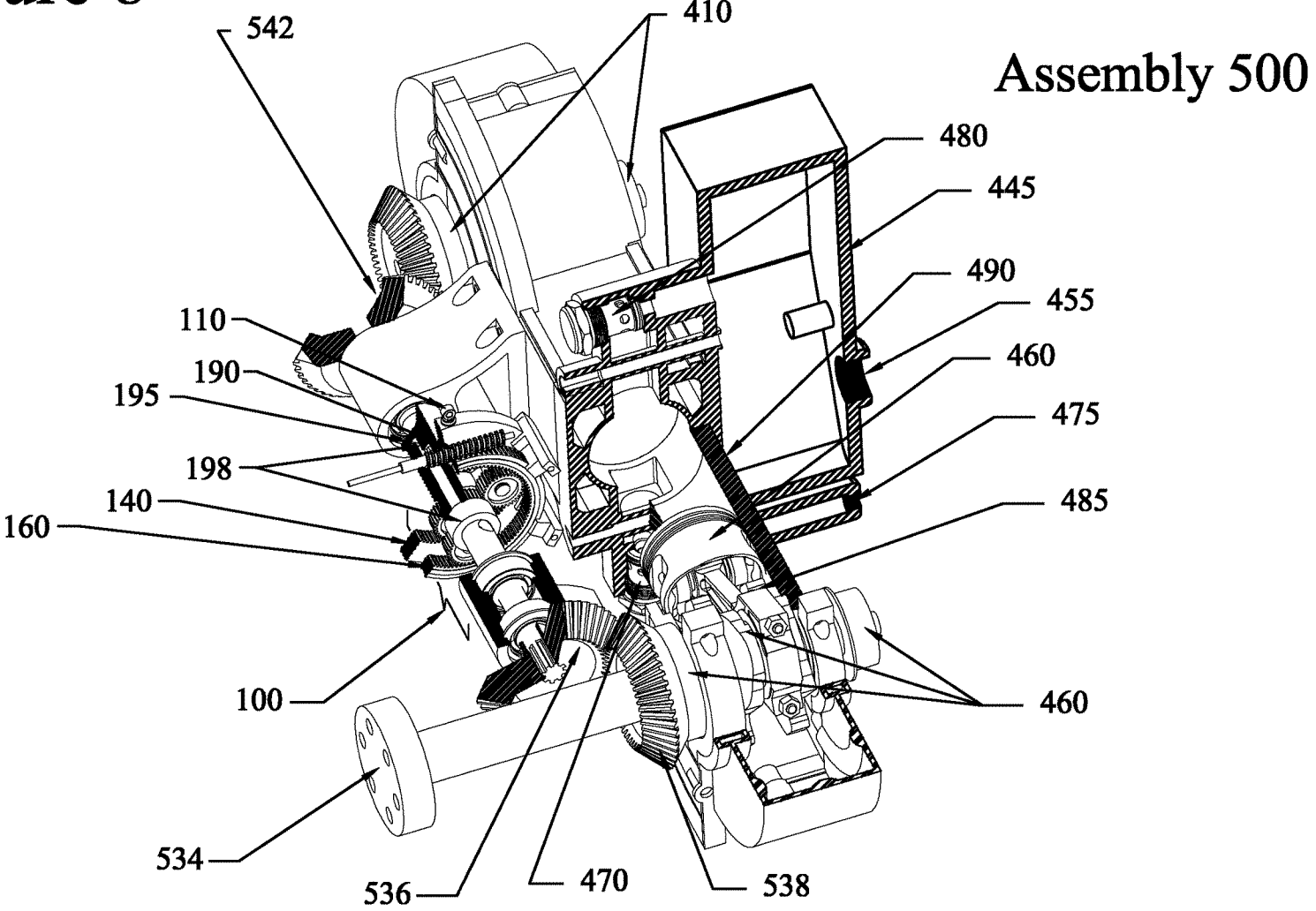
FIG. 8. Is a cut-a-way view of a variable displacement dual crankshaft piston pump wherein the input shaft is directly coupled to both the primary crankshaft and the phase relationship controller input shaft and the secondary crankshaft is connected to the output shaft of the phase relationship controller.

A variation of the embodiment illustrated in FIG. 7 is shown in FIG. 8, where input power is directly applied to one crankshaft (460) by means of a rotating, flanged input shaft (534), and the opposed crankshaft (410) is driven by the output tube (195) of the phase relationship controller (100) by means of a bevel gear (542). The input to the phase relationship controller (100) is driven by a bevel gear (536), said gear (536) is driven by a bevel gear (538) rigidly fixed to the flanged input shaft (534). In some applications, the embodiment shown in FIG. 7 may be beneficial in that the input shaft is aligned with the centerline of the device. The embodiment of FIG. 8 is nonsymmetric, but requires fewer parts (eliminating 4 bevel gears) and will be potentially cheaper to fabricate and more durable than that of FIG. 7. Therefore, the phase relationship controller (100) is configured so there is only one output shaft (195). While all other operating characteristics remain the same, a change in the angular relationship between the input annulus ring (140) and the output annulus ring (160) will alter the phase relationship of the output shaft (195) relative to the input shaft (198). This change in angular relationship will be added to, or subtracted from, the rotations being delivered to the bevel gear (542), said change in angular relationship being transmitted into the left-hand crankshaft (410), which alters the phase relationship between the left-hand piston (460) and the right-hand piston (460).

In summary, when the phase relationship between the input shaft (198) and the output shaft (195) changes, a corresponding phase relationship between the crankshafts (410, 460) is altered. Said change in the phase relationship between the crankshafts (410, 460) is reproduced in the opposed pistons (460). Thereby, the Actuation Device (190) can set and control the effective displacement of the opposed piston (460) cylinder (490) system.

Figure 9:
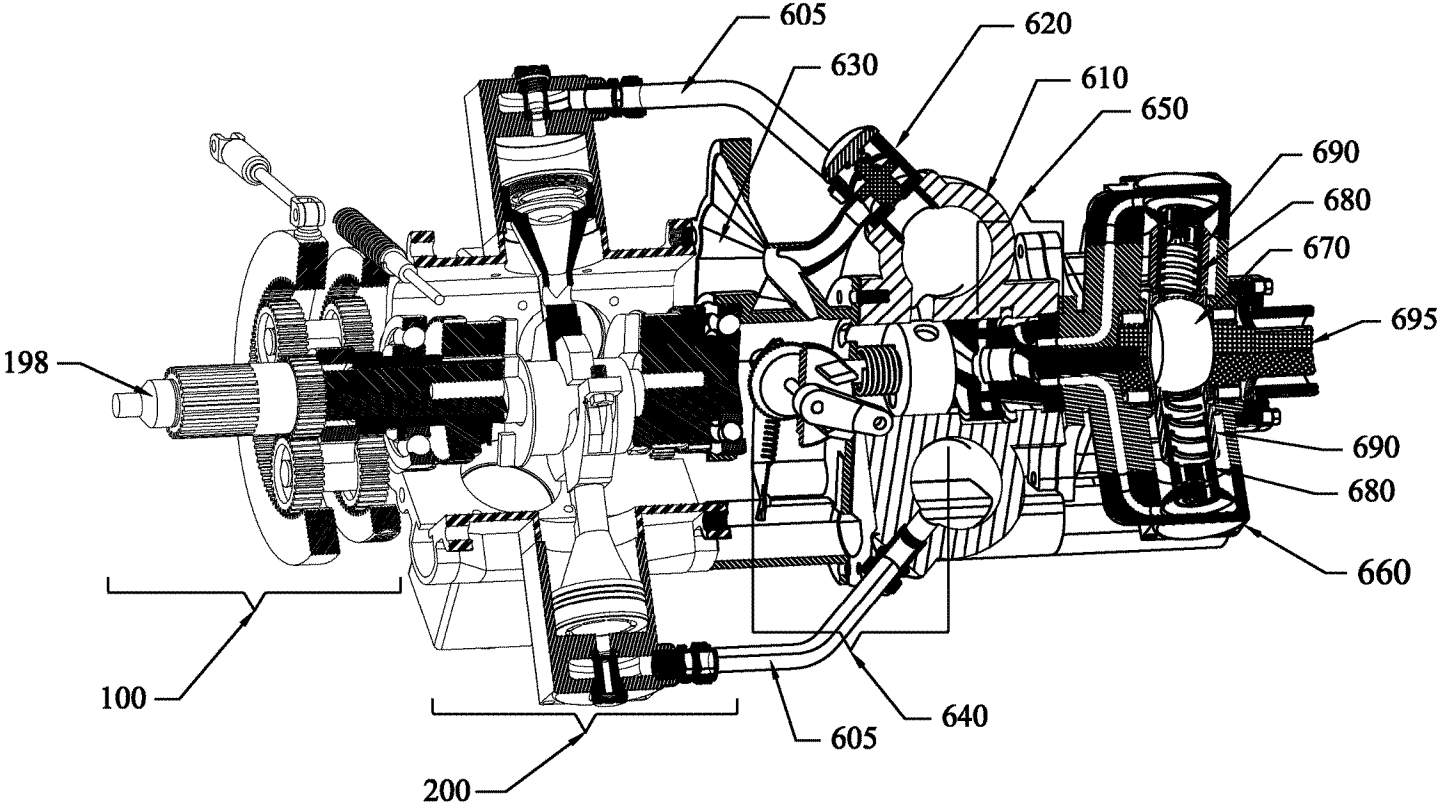
FIG. 9 is a cut-a-way view of a variable displacement radial piston pump configured with piping and a hydraulic motor to function as a continuously variable transmission.

FIG. 9 shows the application of the radial piston, variable stroke, variable displacement hydraulic pump (200) of FIG. 3, integrally coupled with a power consuming apparatus (600). The entire embodiment of FIG. 9 is configured for use as a Constant Speed, Continuously Variable Transmission, whose overall functioning maintains a constant driving source speed of rotation under widely varying conditions of power consumption loading and speed. Said power consuming apparatus consists of a fluid accumulating manifold (610) with an overpressure relief apparatus (620), a drain return manifold assembly (630), a flow reversing mechanism (640), and a typical, commercially available hydraulic motor (660) with a fluid distributor (650), crankshaft (670), piston (680), and cylinder (690).

The quantity of pressurized hydraulic fluid produced from said radial piston, variable stroke, variable displacement hydraulic pump (200) is controlled through the action of the driving phase relationship controller (100), said fluid flow is routed to the accumulating manifold (610) by means of tubing (605). Pressurized fluid is delivered from the accumulating manifold (610) to the hydraulic motor (660) through the reversing mechanism (640) which contains routing passages for both the pressurized fluid from the accumulating manifold (610) and low-pressure fluid being routed from the hydraulic motor (660) to the drain return manifold (630). Said pressurized fluid is ported from the reversing mechanism (640) to the distributor (650), which coordinates the delivery of the pressurized fluid to the pistons (680) and cylinders (690) with the instantaneous position of the crankshaft (670). The distributor (650) also has passages for low-pressure (spent) hydraulic fluid to be delivered from the pistons (680) and cylinders (690) to the reversing mechanism (640) and then to the drain return manifold (630). The distributor (650) also coordinates the draining of fluid from the pistons (680) and cylinders (690) with the instantaneous position of the crankshaft (670).

In overall operation, the system illustrated in FIG. 9 will allow for the setting and control of the displacement of the hydraulic pump so that the rotation of the input shaft (198) can be maintained at a constant speed while the loading and speed of the output shaft (695) varies over a wide range.

Figure 10:
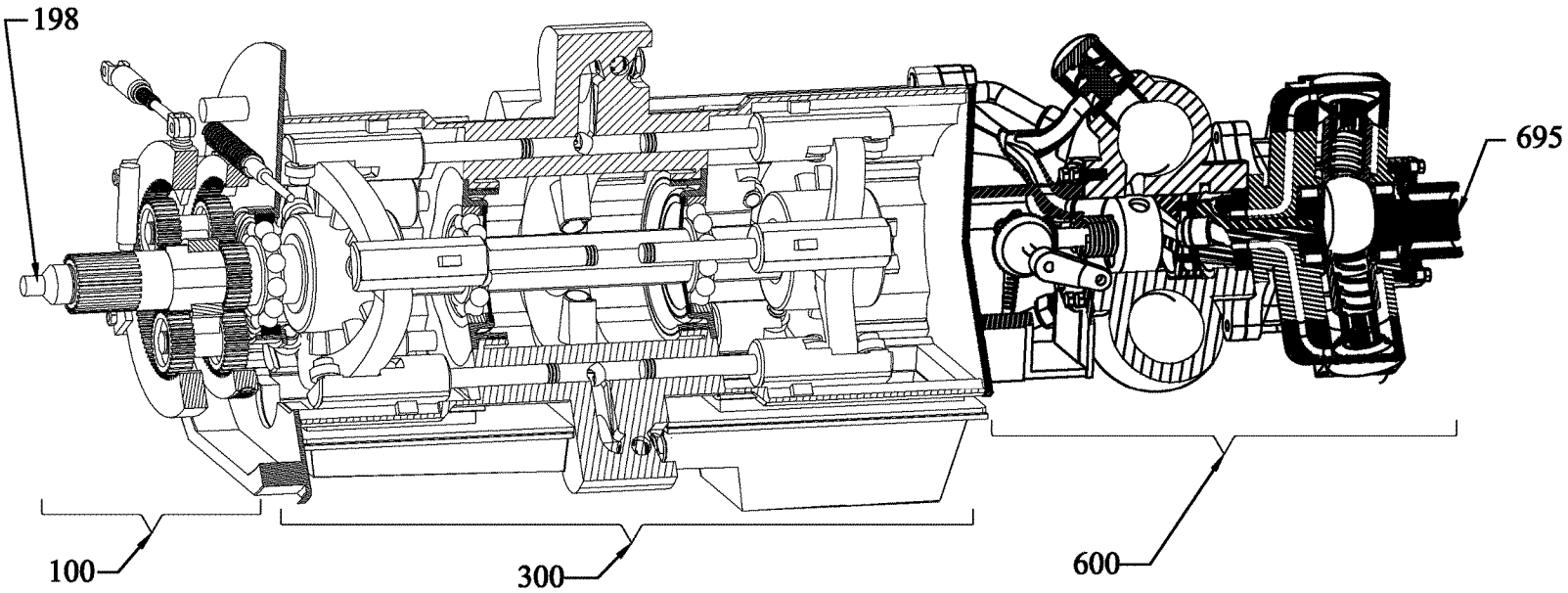
FIG. 10 is a cut-a-way view of a variable displacement axial piston pump configured with piping and a hydraulic motor to function as a continuously variable transmission.

FIG. 10 illustrates the application of the axial, opposed-piston, variable displacement hydraulic pump (300) of FIG. 6 to a Constant Speed, Continuously Variable Transmission, utilizing the same power consuming apparatus (600) of FIG. 9. In a similar manner, the operation of the embodiment shown in FIG. 10 will allow for the setting and control of the displacement of the hydraulic pump so that the rotation of the input shaft (198) can be maintained at a constant speed while the loading and speed of the output shaft (695) varies over a wide range.

Figure 11:
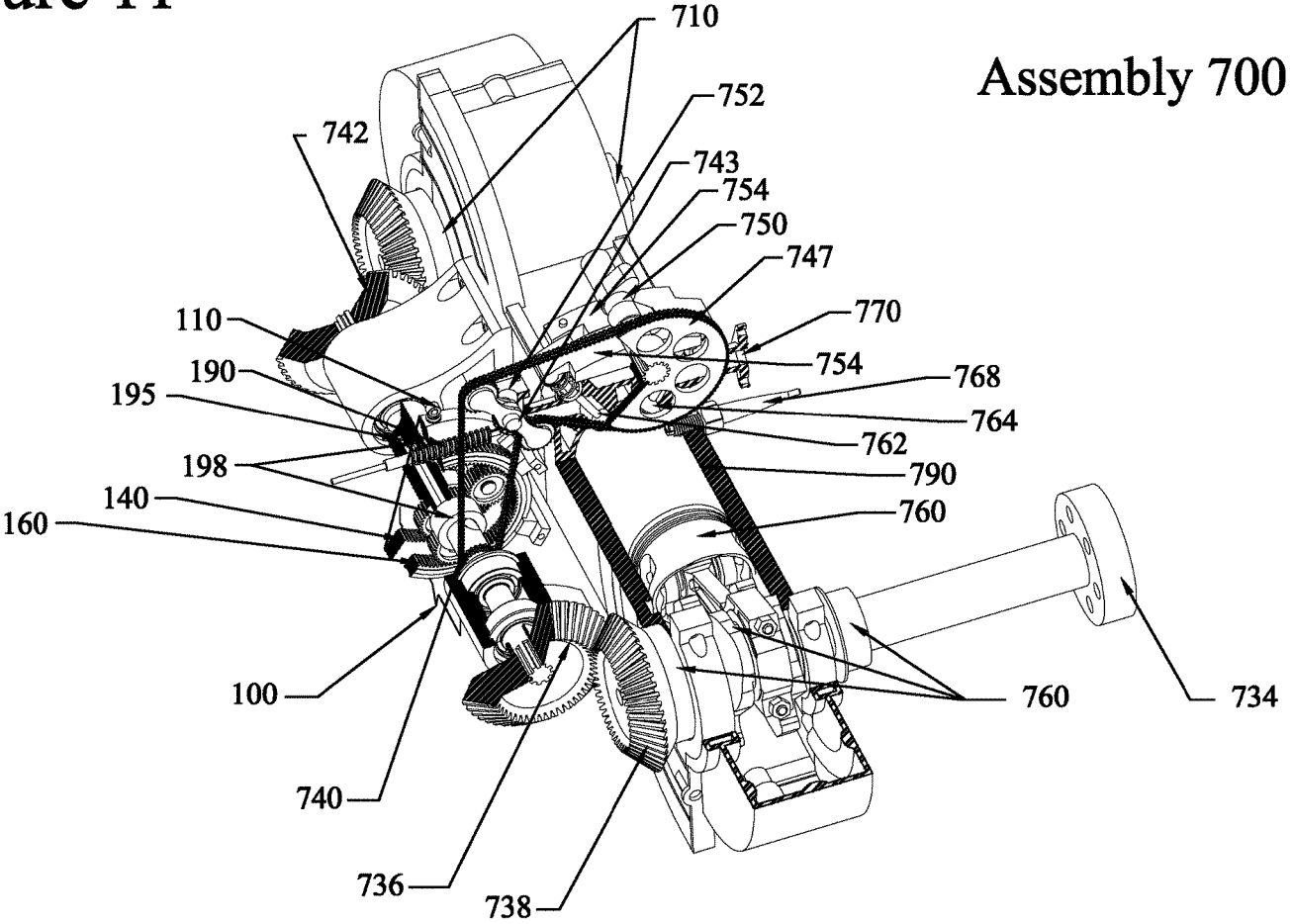
FIG. 11 is a cut-a-way view of a dual crankshaft variable displacement variable compression internal combustion engine.

FIG. 11 contains the embodiment of a mechanism similar to that illustrated in FIG. 8, but reconfigured with additional systems and mechanism to form a dual crankshaft variable displacement variable compression internal combustion engine. In this embodiment, the opposed crankshaft (710) is driven by the output tube (195) of the phase relationship controller (100) by means of a bevel gear (742). The input to the phase relationship controller (100) is driven by a bevel gear (736), said gear (736) is driven by a bevel gear (738) rigidly fixed to the right-hand crankshaft (760), said crankshaft (760) also delivering power out of the engine through a rotating flanged coupling (734).

Additionally, the phase relationship controller (100) input shaft (198) drives a valve timing chain (740) which circulates through a sprocket tensioning system (743) and drives the camshaft sprocket (747), said camshaft sprocket (747) causes the camshaft (750) to rotate at one-half the speed of the input shaft (198) and the righthand crankshaft (760). The lobes of the camshaft drive rocker arm assemblies (754) which individually cause the intake poppet valve (762) and the exhaust poppet valve (764) to open and close in proper coordination for the operation of the internal combustion engine.

A fuel/air mixture is fed into the intake manifold (752) where it is drawn into the cylinder (790) by the pistons (760) as they move away from each other on an intake stroke, while said intake valve (762) is opened.

During a compression stroke of this 4-cycle engine, after the right-hand piston (760) is fully inserted into the cylinder (790), at a compression ratio determined by the phase relationship of the left-hand piston (760) relative to the right-hand piston (760), the fuel/air mixture is ignited by a spark plug (768), and the increasing pressure forces the pistons to execute a power stroke, delivering energy into the flanged coupling (734).

As the pistons (760) initiate an exhaust stroke, the exhaust valve (764) is opened and the exhaust gases are forced by the pistons (760) out of the cylinder (790) through the exhaust port (770).

As in all prior embodiments, any change in the angular relationship between the input annulus ring (140) and the output annulus ring (160) will alter the phase relationship of the output shaft (195) relative to the input shaft (198). This change in angular relationship will be added to, or subtracted from, the rotations being delivered to the bevel gear (742), said change in angular relationship being transmitted into the left-hand crankshaft (710), which alters the phase relationship between the left-hand piston (760) and the right-hand piston (760). Thereby, the Actuation Device (190) can set and control the effective displacement and the compression ratio of the opposed piston (760) cylinder (790) system in a continuous, non-stepwise manner.

This embodiment will allow an instantaneously variable compression ratio, allowing for the engine to quickly adapt to the optimum compression ratio for a large variety of fuels, thereby enhancing fuel efficiency. Additionally, this embodiment has application as a Knock Engine, for analysis of the octane rating of fuels.

Although FIG. 11 uses a particular form to illustrate the application, all discussed embodiments can be adapted for use as an instantaneously variable compression-ratio internal combustion engine by replacing the intake and output check valves with appropriately designed intake and exhaust valves and adding a spark plug to each cylinder.

It is intended that the foregoing detailed description be regarded as illustrative rather than limiting and that it is understood that the following claims including all equivalents are intended to define the scope of the invention.

The invention claimed is:

1. A fluid transport apparatus comprising:

a first shaft having an input portion receiving input and an output portion delivering output, the first shaft being a single-piece constructed shaft;

a second shaft;

a first positive displacement device; and a second positive displacement device;

wherein the second shaft is plesiochronous with the first shaft;

wherein the first positive displacement device is driven by the first shaft;

wherein the second positive displacement device is driven by the second shaft;

wherein the first positive displacement device is a first piston of a pump and the second positive displacement device is a second piston of the pump; and wherein the pump is a variable displacement pump.

2. The fluid transport apparatus of claim 1, wherein the first piston is located in a first cylinder;

the second piston is located in a second cylinder; and the first cylinder is in fluid communication with the second cylinder.

3. The fluid transport apparatus of claim 1, wherein the second shaft is a hollow shaft.

4. The fluid transport apparatus of claim 1, wherein the first shaft and the second shaft are substantially concentric.

5. The fluid transport apparatus of claim 1, wherein an actuator controls a first phase difference between the first shaft and the second shaft.

6. The fluid transport apparatus of claim 1, wherein an actuator controls a second phase difference between the first positive displacement device and the second positive displacement device.

7. The fluid transport apparatus of claim 6, wherein the second phase difference controls a fluid discharge rate of the pump.

8. The fluid transport apparatus of claim 1, wherein a first phase difference between the first shaft and the second shaft controls a discharge rate of the variable displacement pump.

9. The fluid transport apparatus of claim 1, wherein a first fluid displaced by the first positive displacement device is in fluid communication with a second fluid displaced by the second positive displacement device.

10. A fluid transport apparatus comprising:

a first shaft having an input portion receiving input and an output portion delivering output, the first shaft being a single-piece constructed shaft;

a second shaft;

a first positive displacement device; and a second positive displacement device;

wherein the second shaft is plesiochronous with the first shaft;

wherein the first positive displacement device is driven by the first shaft;

wherein the second positive displacement device is driven by the second shaft;

wherein the first positive displacement device is a first piston of an internal combustion engine and the second positive displacement device is a second piston of the internal combustion engine; and wherein the first shaft and the second shaft are substantially concentric.

11. The fluid transport apparatus of claim 10, wherein the first piston is located in a first cylinder;

the second piston is located in a second cylinder; and;

the first cylinder is in fluid communication with the second cylinder.

12. The fluid transport apparatus of claim 10, wherein the second shaft is a hollow shaft.

13. The fluid transport apparatus of claim 10, wherein an actuator controls a first phase difference between the first shaft and the second shaft.

14. The fluid transport apparatus of claim 10, wherein an actuator controls a second phase difference between the first positive displacement device and the second positive displacement device.

15. The fluid transport apparatus of claim 14, wherein the second phase difference controls a compression ratio of the internal combustion engine.

16. A fluid transport apparatus comprising:

a first shaft having an input portion receiving input and an output portion delivering output, the first shaft being a single-piece constructed shaft;

a second shaft;

a first positive displacement device; and a second positive displacement device;

wherein the second shaft is plesiochronous with the first shaft;

wherein the first positive displacement device is driven by the first shaft;

wherein the second positive displacement device is driven by the second shaft;

wherein the fluid transport apparatus further comprises a first sun gear directly attached to the input portion of the first shaft;

a first planet gear being intermeshed with the first sun gear;

a first annulus ring comprising a first internal gear being intermeshed with the first planet gear;

a second sun gear directly attached to the second shaft;

a second planet gear being intermeshed with the second sun gear;

a second annulus ring comprising a second internal gear being intermeshed with the second planet gear; and an actuation device configured to rotate the second annulus ring; and wherein the second shaft is of a cylindrical tube shape and the second shaft is mounted concentrically around the output portion of the first shaft.

17. The fluid transport apparatus of claim 16, wherein a first piston is connected to a first crank shaft;

the first crank shaft is driven by a first drive shaft assembly;

the first drive shaft assembly is driven by a first bevel gear fixed to the output portion of the first shaft;

a second piston is connected to a second crank shaft;

the second crank shaft is driven by a second drive shaft assembly;

the second drive shaft assembly is driven by a second bevel gear fixed to the second shaft;

fluid is suctioned from a reservoir when the first piston and the second piston move apart from each other; and pressurized fluid is prevented from back flowing into the reservoir when the first piston and the second piston are driven closer to each other.

18. The fluid transport apparatus of claim 16, wherein the input portion of the first shaft is driven by a first input bevel gear;

the first input bevel gear is driven by a second input bevel gear;

the second input bevel gear is rigidly fixed to an input crankshaft;

a first output crankshaft and a second output crankshaft are driven by the second shaft through an output bevel gear; and the actuation device controls a compression ratio of a first cylinder and a second cylinder.

19. The fluid transport apparatus of claim 16, wherein the output portion of the first shaft drives an eccentric inner cam mounted on a third shaft;

the output portion of the first shaft has a cut receiving the third shaft;

the second shaft drives an eccentric drive cam through an idler shaft, drive gears, drive spindles, drive slots and slot keys; and the eccentric inner cam rotates within an oval opening of the eccentric drive cam.

* * * * *